US006650042B2

(12) United States Patent
Hammer

(10) Patent No.: US 6,650,042 B2
(45) Date of Patent: Nov. 18, 2003

(54) LOW-WATTAGE FLUORESCENT LAMP

(75) Inventor: Edward E. Hammer, Mayfield Village, OH (US)

(73) Assignee: General Electric Company, Schenectady, NY (US)

( * ) Notice: Subject to any disclaimer, the term of this patent is extended or adjusted under 35 U.S.C. 154(b) by 176 days.

(21) Appl. No.: 09/842,455

(22) Filed: Apr. 26, 2001

(65) Prior Publication Data

US 2002/0185962 A1 Dec. 12, 2002

(51) Int. Cl.[7] ..... H01J 1/88; H01J 61/067

(52) U.S. Cl. ..... 313/491; 313/492; 313/493; 313/578; 313/579; 313/635

(58) Field of Search ..... 313/490, 492, 313/578, 579, 635, 491, 493

(56) References Cited

U.S. PATENT DOCUMENTS 2,935,637 A * 5/1960 Cortese ..... 313/579
3,845,343 A * 10/1974 Hammer ..... 313/635
3,878,421 A * 4/1975 Boehme ..... 313/578
4,032,813 A * 6/1977 Shurgan et al. ..... 313/492
4,093,893 A 6/1978 Anderson ..... 315/48
4,308,650 A * 1/1982 Hernandez et al. ..... 313/490
5,053,933 A 10/1991 Imris ..... 362/221
6,104,134 A 8/2000 Kikuchihara et al. ..... 313/491
6,121,728 A 9/2000 Kikuchihara et al. ..... 313/623

* cited by examiner

*Primary Examiner*—Nimeshkumar D. Patel
*Assistant Examiner*—Sikha Roy
(74) *Attorney, Agent, or Firm*—Pearne & Gordon LLP

(57) ABSTRACT

A low-wattage fluorescent lamp is provided. The lamp has at least one mercury cold spot region effective to maintain the mercury in the lamp at less than 30° C., preferably 25° C., in an enclosed lamp fixture. The lamp also features a reduced distance between electrodes resulting in less power being required to sustain an electric arc discharge during operation of the lamp. The lower power electric arc generates less heat to raise the temperature of mercury vapor within the lamp.

25 Claims, 1 Drawing Sheet

LOW-WATTAGE FLUORESCENT LAMP

BACKGROUND OF THE INVENTION

1. Field of the Invention

The present invention relates generally to a fluorescent lamp, and more particularly to a low-wattage fluorescent lamp utilizing only argon as the inert fill gas.

2. Description of Related Art

Standard T8 lamps utilizing only argon as the inert fill gas have a low lumen efficacy, expressed as lumens per watt of positive column power. These same low-wattage T8 lamps yield reduced positive column power through addition of krypton to the fill gas. The addition of krypton reduces energy consumption in fluorescent lamps because krypton, having a higher atomic weight than argon, results in a lower wattage gradient in the positive column with lower heat conduction losses per unit length of discharge in the lamp. However, a major disadvantage of krypton is that it suppresses the Penning ionization effect, thereby making the lamp more difficult to start on standard ballasts. Consequently, an attached starting aid, such as a conductive stripe applied along the length of the lamp, must be used to effect reliable starting of low-wattage fluorescent lamps utilizing krypton in the fill gas. However, the addition of a conductive stripe contributes an additional manufacturing step as well as additional material and manufacturing cost.

Still a further disadvantage of krypton is that striations are substantially more prevalent in fluorescent lamps utilizing krypton in the fill gas than in lamps containing only argon. Striations are an undesirable feature to consumers in a finished fluorescent lamp product.

Still a further disadvantage of krypton-containing lamps is that they are primarily compatible only with instant-start ballasts. Existing low-wattage krypton-containing lamps may not be compatible with rapid-start ballasts.

It is desirable to produce a low-wattage fluorescent lamp containing only argon as the inert fill gas that consumes less energy to achieve similar lumen efficacy as compared to krypton-containing T8 lamps. Such a low-wattage lamp would also substantially eliminate striations associated with krypton-containing lamps. Preferably, such a lamp would function with both instant-start and rapid-start ballasts. Preferably, such a lamp would also be effective to maintain the pressure of mercury vapor in the optimum range of 6–10 $\mu$m when used in high-temperature enclosed lamp fixtures.

SUMMARY OF THE INVENTION

A low pressure mercury vapor discharge lamp is provided having a light-transmissive glass envelope having an inner diameter and an inner surface, with first and second lamp bases attached at each end of the glass envelope, a phosphor layer coated adjacent the inner surface of the glass envelope, a discharge-sustaining fill gas of mercury vapor and an inert gas sealed inside the envelope, first and second electrodes mounted within the envelope, and a mercury cold spot region at an end of the envelope behind the first electrode. Each electrode has has a mount height measured from the electrode to the proximate inner end surface of the glass envelope. The mount height of the first electrode is at least 31 mm.

DETAILED DESCRIPTION OF THE PREFERRED EMBODIMENTS OF THE INVENTION

Figure 1:
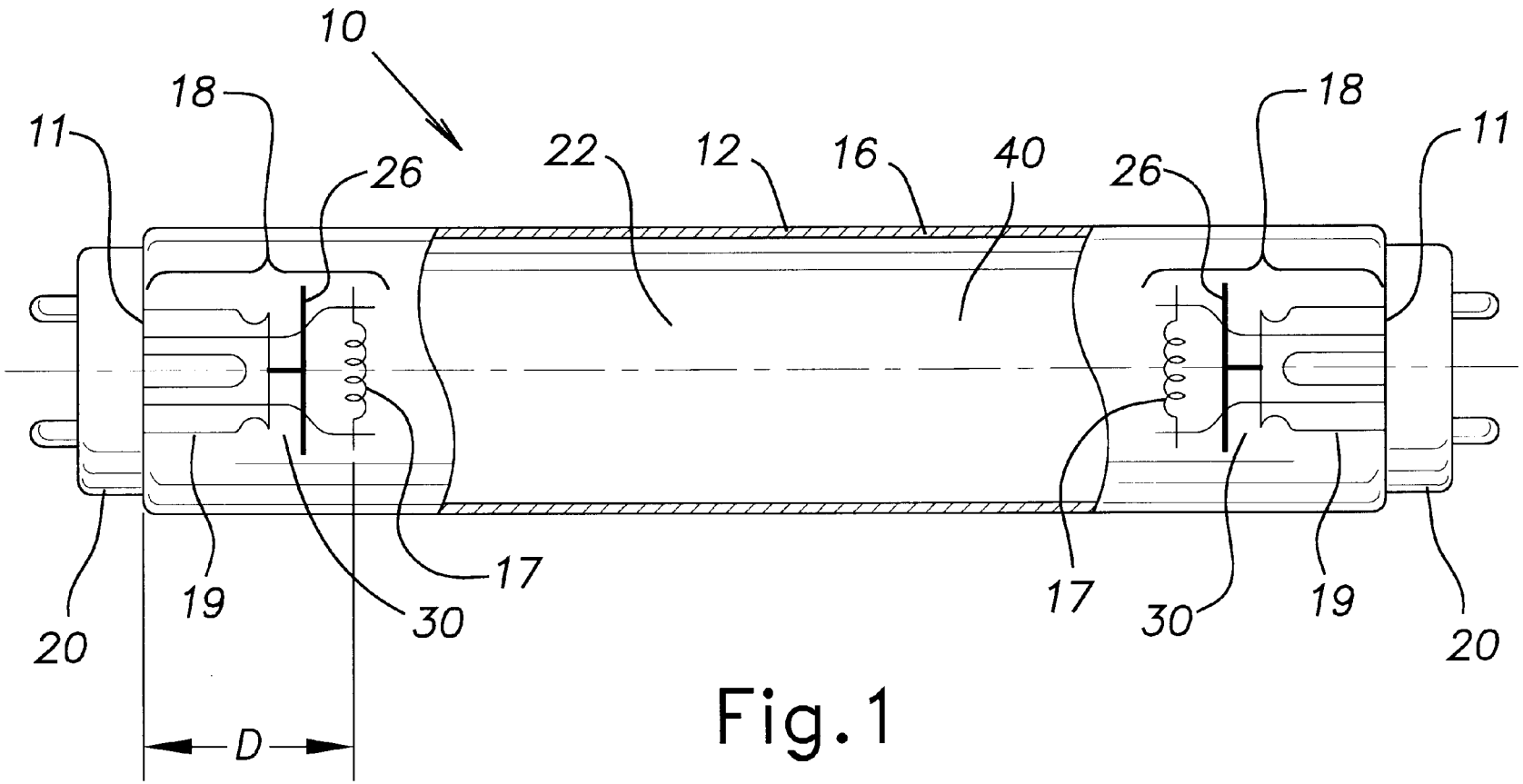
FIG. 1 is a side view, partially in section, of a low pressure mercury vapor discharge lamp according to the present invention.

As used herein, when a preferred range, such as 5 to 25 (or 5–25), is given, this means preferably at least 5, and separately and independently, preferably not more than 25. Unless otherwise specifically indicated, all gas compositions reported in percents are volume percents (vol. %).

As used herein, "ballast" means either a high frequency electronic or low frequency electromagnetic ballast as known in the art, comprising a ballast circuit adapted to convert line voltage at 50–60 Hz into an output signal adapted to operate a fluorescent lamp. In the case of a high frequency electronic ballast, the output signal is a high frequency AC output signal in the range of 20–150, preferably 20–100, preferably 20–80, preferably 20–50, preferably 25–40, kHz, and has an output voltage in the range of 150–1000V. The electronic ballast may be either an instant-start ballast or a rapid-start ballast and is adapted to operate a T8 fluorescent lamp as known in the art.

Also as used herein, a "T8 fluorescent lamp" or "standard T8 lamp" is a fluorescent lamp as commonly known in the art, preferably linear, preferably 48 inches in length, and having a nominal outer diameter of 1 inch (eight times ⅛ inch, which is where the "8" in "T8" comes from). Less preferably, the T8 fluorescent lamp can be nominally 2, 3, 6, or 8 feet in length. Alternatively, a T8 fluorescent lamp may be nonlinear, for example circular or otherwise curvilinear, in shape.

As used herein, an "Ultra 1" lamp is a low-wattage T8 fluorescent lamp as known in the art, having an inert fill gas comprising about 75 vol. % argon and 25 vol. % krypton.

As used herein and in the claims, wattages are as measured on the standard IES 60 Hz reference circuit known in the art.

FIG. 1 shows a low pressure mercury vapor discharge fluorescent lamp 10 according to the present invention. The fluorescent lamp 10 has a light-transmissive glass tube or envelope 12 having a circular cross-section, and terminating at an inner end surface 11 at each end. The glass envelope 12 preferably has a nominal outer diameter of 1 inch, less preferably less than 1 inch, less preferably more than 1 inch. The glass envelope preferably has a length of about 118 cm, though the glass envelope may optionally have a different length.

The lamp is hermetically sealed by lamp bases 20 attached at both ends, and a pair of spaced electrode assemblies 18 are respectively mounted on the lamp bases 20. Each electrode assembly has an electrode 17 mounted on an electrode base 19. Each electrode 17 is mounted at an electrode mount height D. As shown in FIG. 1, the mount height D is measured from the electrode 17 to the proximate inner end surface 11 of the glass envelope 12. Also as shown in FIG. 1, a mercury cold spot region 30 is located at at least one, preferably at both, of the ends of the glass envelope 12 behind the electrodes 17. Each mercury cold spot region 30 is bounded by: 1) a plane perpendicular to the longitudinal axis of the glass envelope and intersecting the electrode 17; 2) the proximate inner end surface 11; and 3) the inner surface of the glass envelope between the plane and the inner end surface 11. Hence, cold spot region 30 is a substantially cylindrical region within the glass envelope having a length corresponding to the mount height D, which is measured from an electrode 17 to the proximate inner end surface 11 of glass envelope 12.

Thus, the volume of the mercury cold spot region 30 is proportional to the mount height D, and can be adjusted by varying the length of electrode base 19 and/or the spacing of electrode 17 from inner end surface 11. The location of electrode 7 is selected to provide a mount height D of preferably about or at least 31, preferably 33, preferably 35, preferably 37, preferably 39, preferably 41, preferably 43, preferably 45, mm. Preferably the ratio of mount height D to the length of glass envelope 12 is at least or not more than 0.026, 0.028, 0.030, 0.031, 0.033, 0.035, 0.036, or 0.038. A discharge-sustaining fill gas 22 of mercury and an inert gas is sealed inside the glass envelope 12. The inert gas is preferably pure (100 vol. %) argon, or substantially pure (substantially 100 vol %) argon according to the invention.

The inert gas and a small quantity of mercury provide the low vapor pressure manner of operation. The total pressure of fill gas 22 is preferably 2.1–2.5, most preferably about 2.3, torr. Lamp 10 also has a phosphor layer 16 disposed or coated adjacent the inner surface of glass envelope 12 as well known in the art.

A lamp having at least one mercury cold spot region 30 according to the invention operates at reduced wattage without sacrificing lumen efficacy compared to standard T8 lamps known in the art. Without wishing to be bound by any particular theory, it is believed that the invented lamp provides improved performance for one or several of the following reasons.

During operation of a T8 lamp, electrical energy from an electric discharge or arc between electrodes 17 excites gaseous mercury atoms present in the discharge sustaining fill gas 22. These excited mercury atoms emit UV radiation at a wavelength of 254 nm and, to a lesser extent, at other wavelengths, upon returning from the excited state to the ground state. This 254 nm radiation is then absorbed by phosphors in the phosphor layer 16, and converted into visible light as known in the art. Mercury vapor exhibits its optimal 254 nm resonance band at a mercury vapor pressure of 6–10 $\mu$m Hg. Therefore, a T8 lamp is typically filled with sufficient liquid mercury to achieve its equilibrium vapor pressure of 6–10 $\mu$m Hg within the lamp at 25° C. However, in practice, the temperature of fill gas 22 (and therefore of mercury vapor) in standard T8 lamps can rise significantly above 25° C. (i.e. greater than 35° C.) as a result of heat generated by the electric arc between the electrodes 17. This increased temperature results in increased mercury vapor pressure well above the optimal 6–10 $\mu$m Hg range. As a result, mercury vapor emission at 254 nm is reduced, causing lower light output at higher wattage. Because mercury vapor's optimal 254 nm resonance band occurs at 6–10 $\mu$m Hg pressure, T8 lamps are designed around the 25° C. reference condition at which mercury's vapor pressure falls within the above optimal range. Therefore, it is not possible to account for the virtually infinite variety of open and enclosed lamp fixtures in the marketplace that dissipate heat from an operating T8 lamp to varying degrees of effectiveness. Negative high temperature effects are particularly prevalent in enclosed lamp fixtures that do not provide adequate means of heat dissipation from an operating lamp, often resulting in a lamp operating temperature as high as 35° C. or greater.

By increasing the mount height D, the distance between electrodes 17 in the positive column 40 (which is the volume within glass envelope 12 between electrodes 17) is decreased, resulting in lower power (i.e. less wattage) required to produce an electric arc that extends between the electrodes 17, thereby exciting mercury atoms to resonance. In the most preferred embodiment employing two mercury cold spot regions 30, wherein each electrode 17 has a mount height D of 45 mm, the distance between the electrodes 17 in the positive column 40 is about 32 mm shorter than that of a standard T8 lamp (where the mount height D is 29 mm). The shorter distance between electrodes 17 results in a lower-power electric arc producing less heat to raise the mercury vapor temperature (and thereby its vapor pressure) outside the optimal range.

In addition, the mercury cold spot regions 30 disposed behind electrodes 17 are maintained at a lower temperature relative to the positive column 40, because the mercury cold spot regions are not exposed to the electric arc discharge. Therefore, higher pressure mercury vapor from the positive column 40 that has been heated by the electric arc migrates to the cold spot regions 30 via natural convection as known in the art, where it cools and returns to the optimal pressure range of 6–10 $\mu$m Hg. In this manner, the vapor pressure of mercury in the invented lamp is regulated as a function of the temperature in the mercury cold spot regions 30, and is less dependent upon the specific fixture in which the lamp is mounted. A mercury cold spot region according to the invention is effective to maintain the average temperature of mercury vapor in the lamp at about or less than 25° C., less preferably 26, 27, 28, 29, or 30, degrees Celsius, during operation in an enclosed fixture.

It will be understood that the invented lamp provides greater efficiency in at least two ways. First, power consumption is reduced by shortening the distance between electrodes 17, thus reducing the total power required to create the necessary electric arc discharge between the electrodes. Second, the pressure of mercury vapor is maintained within or closer to the optimal range of 6–10 $\mu$m Hg for 254 nm resonance. Thus, power consumption is decreased while lumen efficacy is maintained.

As indicated above, the invented lamp will have particular utility in enclosed fixtures where there exists insufficient mechanism to dissipate heat resulting from lamp operation. Standard T8 lamps that do not incorporate a mercury cold spot region experience a progressive reduction in efficiency and light output during operation as the temperature within the lamp fixture rises. The electric arc spans nearly 98% the length of the glass envelope of standard T8 lamps, creating a substantially uniform temperature profile throughout the lamp, providing a smaller lower temperature region where heated mercury vapor can migrate to cool down and return to its optimal pressure. As the temperature in the lamp (and consequently in the enclosed fixture) rises, heat from the lamp is less effectively dissipated to the outside, and becomes absorbed by the fill gas 22 (which includes the mercury vapor), thus increasing its temperature.

The invented lamp consumes less energy and therefore requires less dissipation of excess heat energy, and furthermore provides its own internal mechanism for maintenance of mercury vapor within or closer to the optimal 6–10 $\mu$m Hg pressure range.

Optionally, a heat shield 26 can be provided behind the electrode 17 to prevent direct thermal radiation from electrode 17 to the mercury cold spot region 30. Preferably, the heat shield is mounted to the electrode base 19 via support members, less preferably via some other known means. The heat shield 26 is preferably disk shaped and made from metal, preferably stainless steel, less preferably aluminum, less preferably nickel, copper, chromium, gold, or silver, less preferably some alloy of one or more of the above. Optionally, heat shield 26 is coated, preferably on the side facing the discharge (and the electrode), with an infrared reflective material, e.g. gold, silver, nickel, titanium, or chromium. The heat shield has a diameter preferably not more than 80% that of the inner diameter of glass envelope 12. The heat shield 26 is preferably provided with at least one hole to accommodate the lead wires of electrode 17 without short circuiting the lead wires. Most preferably, heat shield 26 is electrically insulated from the lead wires.

Further aspects of the invention will be better understood in conjunction with the following example.

EXAMPLE 1

A test was conducted comparing an invented lamp having two mercury cold spot regions with a standard T8 lamp having a fill gas of argon, and an Ultra 1 lamp having a fill gas of about 75 vol. % argon and 25 vol. % krypton. All three lamps were linear, 4 feet in length, and had a one inch nominal outer diameter. The total gas pressure in the standard and invented T8 lamps was 2.3 torr at 25° C., and that in the Ultra 1 lamp was 2.1 torr at 25° C. All three lamps were initially filled with about 15 mg of mercury. This represented an equilibrium excess of mercury at 25° C., such that the vapor space in each lamp contained 6–10 $\mu$m Hg of mercury vapor (in equilibrium with excess liquid mercury) at 25° C. The electrode mount height of the standard and Ultra 1 lamps was 29 mm, and that of the invented lamp was 45 mm. All three lamps were tested in an environmentally controlled chamber at two discrete temperatures, 15° C. and 25° C., and lamp wattages were measured during operation of each lamp. Lamp wattage is the sum of electrode wattage (resulting from electrode heat losses) and positive column wattage (required to sustain the electric arc discharge). Electrode wattages in all three lamps were essentially constant as similar electrodes were employed in all three lamps. Therefore, the relative differences in total lamp wattage among the tested lamps resulted from differing positive column wattage only. Results are presented below in table 1.

TABLE 1

Comparison of invented lamp with standard T8 and Ultra 1 lamps

| Current (mA) | Standard T8 Lamp (Ar fill gas) (Watts) | Ultra 1 Lamp (Ar/Kr fill gas) (Watts) | Invented Lamp (Ar fill gas) (Watts) |
|---|---|---|---|
| | Temperature = 15° C. | | |
| 150 | 21.9 | 19.7 | 20.6 |
| 180 | 25.4 | 22.7 | 23.8 |
| 210 | 28.7 | 25.6 | 26.7 |
| | Temperature = 25° C. | | |
| 150 | 21.9 | 20.2 | 21.6 |
| 180 | 25.3 | 23.4 | 24.9 |
| 210 | 28.6 | 26.3 | 28.2 |

As can be seen from table 1, the invented lamp drew less power than the standard T8 lamp to sustain an arc between the electrodes having the same current. At 15° C., the invented lamp consumed an average of 6.4±0.5 percent less power than the standard T8 lamp over the range of electrical currents tested. Likewise, at 25° C., the invented lamp consumed an average of 1.5±0.1 percent less power than the standard T8 lamp over the range of electrical currents tested. Such a high degree of power savings was a surprising an unexpected result.

It will be noted that the Ultra 1 lamp consumed less energy than the invented lamp at both temperatures. However, the invented lamp has several distinct advantages over Ultra 1 lamps. First, the invented lamp can be used in both instant-start and rapid-start electronic ballasts already present in the marketplace, whereas krypton-containing Ultra 1 lamps are only compatible with instant-start ballasts. Second, an invented lamp provides a low-wattage alternative to standard T8 lamps in a variety of enclosed fixtures lacking adequate ventilation or heat dissipation capacity without the negative effect of striations that are prevalent among krypton-containing lamps. Third, an invented lamp does not require an attached starting aid, such as a conductive stripe, to assist starting on any ballast. Fourth, an invented lamp is produced at significantly reduced cost because it contains neither krypton nor any attached starting aid. Hence, the higher efficiency of Ultra-1 lamps is offset by their higher production cost.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A low pressure mercury vapor discharge lamp comprising a light-transmissive glass envelope having an inner diameter and an inner surface, first and second lamp bases attached at each end of said glass envelope, a phosphor layer coated adjacent said inner surface of said glass envelope, a discharge-sustaining fill gas of mercury vapor and an inert gas sealed inside said envelope, first and second electrodes mounted within said envelope, and a mercury cold spot region at an end of said envelope behind said first electrode, said glass envelope having a substantially constant inner diameter and terminating at first and second inner end surfaces located respectively at either end of said glass envelope, each electrode having a mount height measured from said electrode to the proximate inner end surface of said glass envelope, the mount height of said first electrode being at least 31 mm.

2. A lamp as in claim 1, wherein said second electrode has a mount height of at least 31 mm.

3. A lamp as in claim 1, said fill gas consisting of mercury vapor and argon.

4. A lamp as in claim 1, further comprising a heat shield behind said first electrode in said mercury cold spot region.

5. A lamp as in claim 4, said heat shield being disk shaped, and having a diameter not more than 80% the inner diameter of said glass envelope.

6. A lamp as in claim 4, said heat shield being a metal heat shield.

7. A lamp as in claim 4, said heat shield having an infrared reflective material coated thereon facing said first electrode.

8. A lamp as in claim 7, wherein said infrared reflective material is selected from the group consisting of gold, silver, nickel, titanium, and chromium.

9. A lamp as in claim 1, wherein the pressure of said fill gas is 2.1–2.5 torr at 25° C.

10. A lamp as in claim 1, wherein said mount height is at least 35 mm.

11. A lamp as in claim 1, wherein said mount height is at least 41 mm.

12. A lamp as in claim 1, wherein said mercury cold spot region is effective to maintain the average temperature of mercury vapor at less than 30° C. during operation of said lamp.

13. A lamp as in claim 1, said mercury cold spot region being effective to maintain the vapor pressure of mercury at 6–10 $\mu$m Hg during operation of said lamp.

14. A lamp as in claim 1, said lamp being adapted to operate with an instant-start ballast.

15. A lamp as in claim 1, said lamp being adapted to operate with a rapid-start ballast.

16. A lamp as in claim 1, wherein said lamp is a T8 fluorescent lamp.

17. A lamp as in claim 16, wherein said lamp is 4 feet in length.

18. A lamp as in claim 16, wherein said T8 fluorescent lamp is linear.

19. A lamp as in claim 1, wherein the ratio of said mount height to the length of said glass envelope is at least 0.026.

20. A lamp as in claim 19, said ratio being not more than 0.038.

21. A lamp as in claim 1, said mercury cold spot region being a substantially cylindrical region within said glass envelope bounded by: a) a plane perpendicular to a longitudinal axis of said glass envelope that intersects said first electrode, b) said inner end surface of said glass envelope that is proximate to said first electrode and c) said inner surface of said glass envelope between said plane and said proximate inner end surface.

22. A lamp as in claim 13, said mercury cold spot region being a substantially cylindrical region within said glass envelope bounded by: a) a plane perpendicular to a longitudinal axis of said glass envelope that intersects said first electrode, b) said inner end surface of said glass envelope that is proximate to said first electrode and c) said inner surface of said glass envelope between said plane and said proximate inner end surface.

23. A lamp as in claim 13, said mercury cold spot region being effective to maintain an average temperature of mercury vapor in said lamp at less than 30° C. during operation of said lamp.

24. A lamp as in claim 13, further comprising a heat shield behind said first electrode in said mercury cold spot region.

25. A lamp as in claim 24, said heat shield being disk shaped, and having a diameter not more than 80% the inner diameter of said glass envelope.

* * * * *